United States Patent [19]

Hame et al.

[11] 4,299,659

[45] Nov. 10, 1981

[54] APPARATUS FOR STORING SELF-HEATING RADIOACTIVE MATERIALS

[76] Inventors: Walter Hame, Johannes-Brahms-Strasse 16, 7520 Bruchsal; Ortwin Knappe, Grünaustrasse 19, 6450 Hanau 9, both of Fed. Rep. of Germany

[21] Appl. No.: 122,493

[22] Filed: Feb. 19, 1980

[30] Foreign Application Priority Data

Feb. 21, 1979 [DE] Fed. Rep. of Germany ..... 2906629

[51] Int. Cl.[3] ..... G21C 19/20

[52] U.S. Cl. ..... 376/272; 250/506

[58] Field of Search ..... 176/30; 250/506, 507

[56] References Cited

U.S. PATENT DOCUMENTS 3,667,540 6/1972 Kupp ..... 250/507

3,911,684 10/1975 Busey ..... 250/507

FOREIGN PATENT DOCUMENTS 2730729 1/1978 Fed. Rep. of Germany ..... 176/30

2711405 9/1978 Fed. Rep. of Germany ..... 176/30

*Primary Examiner*—Donald P. Walsh

*Attorney, Agent, or Firm*—Cushman, Darby & Cushman

[57] ABSTRACT

Self heating radioactive materials, especially irradiated fuel elements, are stored by using dry storage in which the stored material is arranged enclosed vertically in containers. A better cooling effect is attained if the receptions positions in the storage support is arranged horizontally.

11 Claims, 5 Drawing Figures

APPARATUS FOR STORING SELF-HEATING RADIOACTIVE MATERIALS

BACKGROUND OF THE INVENTION

The invention is directed to an apparatus for storing self heating radioactive materials, especially for the storage of irradiated fuel elements from nuclear reactors, which in a given case are enclosed in containers. This apparatus consists essentially of a reinforced concrete shell having inlet and outlet air shafts for natural convection of the cooling medium and one or more storage racks for receiving the radioactive materials.

Self-heating radioactive waste, as e.g. burned up fuel elements from pressure and boiling water reactors, at present are preferably stored under water in order to decrease the activity of the fission and activation products to decay. The water hereby fulfills simultaneously the functions of the shielding of the radioactive irradiation and the cooling of the hot fuel elements or the waste containers.

The cooling of the fuel elements is necessary in order to lead off the liberated decay heat the amount of which is dependent upon the size of the burn-up in the reactor and the cooling time already elapsed.

The heat is carried off from the cooling water to the environment for the most part in external coolers through a secondary cooling water circuit and a wet cooling tower. Due to the small heating up stretches available there result relatively large cooling water throughputs and large cooling surfaces. The storage of burned-up fuel elements from nuclear power plants in water tanks therefore has the disadvantage that there occurs a high consumption of cooling water, the environment is molested through the cooling towers and the purification of the water as well as the intermediate and final treatment of the separated radioactive waste is expensive.

Besides there is necessary a high expense for sealing and therewith expense for safety for the water tanks since the water can be radioactively contaminated through leaks which cannot be entirely avoided in the fuel element jackets and additionally the unavoidable radiolysis of the water basis must be controlled.

Furthermore with accidents which could lead to a lost of the cooling medium there is no longer guaranteed sufficient removal of heat so that in addition extensive reserve cooling systems are necessary.

Therefore there have also been known proposals to insert radioactive waste in so-called dry storage in which a gas preferably air, is used as cooling medium that carries off the heat from the stationary stored material in the storage racks by forced cooling with, e.g. fans over heat exchangers or directly to the surroundings. However, there is the disadvantage thereby that in accidents, i.e. breakdown of the cooling system or the cooling aggregate there is no longer guaranteed sufficient transportation of heat which can lead to inadmissible increases in temperature and to the setting free of toxic radioactive materials.

For these reasons dry storage was developed in which the heat is led off through natural convection. These systems are inherently safe since, because of the natural convention, they do not require any active components or operating aggregate to maintain the cooling operation. There is known an apparatus (German OS No. 2730729 and related Klein U.S. application Ser. No. 922,352 filed July 6, 1978) in which the heat of the active waste is led off through natural convection in a closed cell on heat exchanger walls and likewise in an outer cooling system gives up heat to the surroundings through natural convection (indirect cooling).

From German OS No. 2711405 (and related Pirk U.S. application Ser. No. 884,818 filed Mar. 9, 1978) there is known an apparatus in which the heat of the radioactive waste is led off through natural convection directly to the air of the surrounding (direct cooling). In both apparatus the encased stored material is inserted into concrete chambers in vertical shafts through which the cooling medium air flows upward through the stored material because of the heating and thus leads off the heat.

The vertical storage of self heating radioactive wastes which above all is dependent on the available transportation and storage devices has the disadvantage that substantially higher temperatures occur in the upper end of the shafts than in the lower. Besides with multiple charging of the individual shafts the freshly stored containers giving off, especially large amounts of heat normally are stored uppermost in the shafts where the poorer cooling conditions prevail. With indirect cooling there is customarily a disparity between primary heat exchanger surfaces (sum of the surface areas of the stored materials in the shafts) and secondary heat exchange surfaces (effective surfaces of the walls). There is obtained thereby a relatively high temperature level at the stored material. Furthermore, with the vertical storing relatively large incoming air and outgoing air shafts and openings are necessary which for reasons of industrial safety must be equipped safe from sabotage, airplane collision and earthquake.

Therefore it was the problem of the present invention to develop an apparatus for storing self heating radioactive materials, especially irradiated fuel elements, which in a given case are enclosed in containers, in which there is attainable a safe cooling even in the case of accident, a most uniform temperature distribution along the container containing the radioactive materials and above all a safe arrangement of the incoming and outgoing air openings with the smallest possible cross section. Thereby the apparatus should consist essentially of a concrete chamber with incoming and outgoing air shafts for natural convection of the cooling medium and one or more storage supports for receiving radioactive materials.

SUMMARY OF THE INVENTION

This problem was solved according to the invention by arranging the receiving positions in the storage supports horizontally.

Advantageously there are arranged several storage racks on top of one another or besides each other in the concrete chamber. There can serve for example as receiving positions in the storage racks open or closed shafts which give either no resistance or only little resistance to an unhindered supply of cooling agent.

The apparatus of the invention has the advantage of a better cooling of the stored materials since this takes place essentially more effectively with horizontal or even storage slightly inclined in the horizontal direction than with vertical storage. The cooling medium flows around the stored material keeping at a constant temperature along its entire length, whereas a temperature profile only exists along the periphery of the container containing the radioactive materials.

The apparatus of the invention is useful for both direct and indirect cooling in natural convection. Advantageously thereby the receiving positions of the storage racks are fitted out as tubes and provided with spacers in which the containers can be inserted. In this illustrative form of the invention one operates with indirect cooling whereby the cooling medium leads off the heat transferred from the inner cooling cycle to the tube surfaces. Hereby the secondary heat exchanger surface (tube surface) is greater than the surface of the stored material giving off heat (container surface), so that also with indirect cooling there is attained a good removal of heat with the advantage of the safe enclosure of the radioactive material even with leakages, by complete separation of the inner cooling system from the outer by use of closed tubes as receiving positions in the storage supports.

Freshly stored material with the greatest rate of production of heat can always be stored with the device of the invention under optimum cooling conditions, i.e., in receiving positions of the storage racks which are flowed at first of the cooling stream, so that it is cooled with the air which is still not heated.

It is advantageous to additionally install cooling flanges, irradiation shields and/or baffle plates at the storage racks in order to improve the heat transfer from the stored materials to the cooling medium.

Furthermore it is advantageous that the container with the storage material can be handled horizontally which reduces the danger of the containers falling during handling or in certain cases reduces the effects of falling since the larger shell surface of the container is thereby loaded and not the front surface as is the case with the vertical handling in vertical shafts.

The incoming and outgoing air openings in the reinforced concrete shell required because of the natural convection must be safe from sabotage, airplane collision and earthquakes. In comparison to apparatuses with vertical storage of the radioactive material, with horizontal storage these openings can be of surprisingly smaller shape since a better heat transfer takes place with these apparatuses and lower temperature levels are established. These facts have the great advantage that less expenditures are necessary for the safety of these openings or the security against sabotage, airplane collisions or earthquakes can be increased further.

BRIEF DESCRIPTION OF THE DRAWINGS

The invention will be understood best in connection with the drawings wherein.

The apparatus can comprise, consist essentially of or consist of the elements set forth.

DESCRIPTION OF THE PREFERRED EMBODIMENTS

Figure 1:
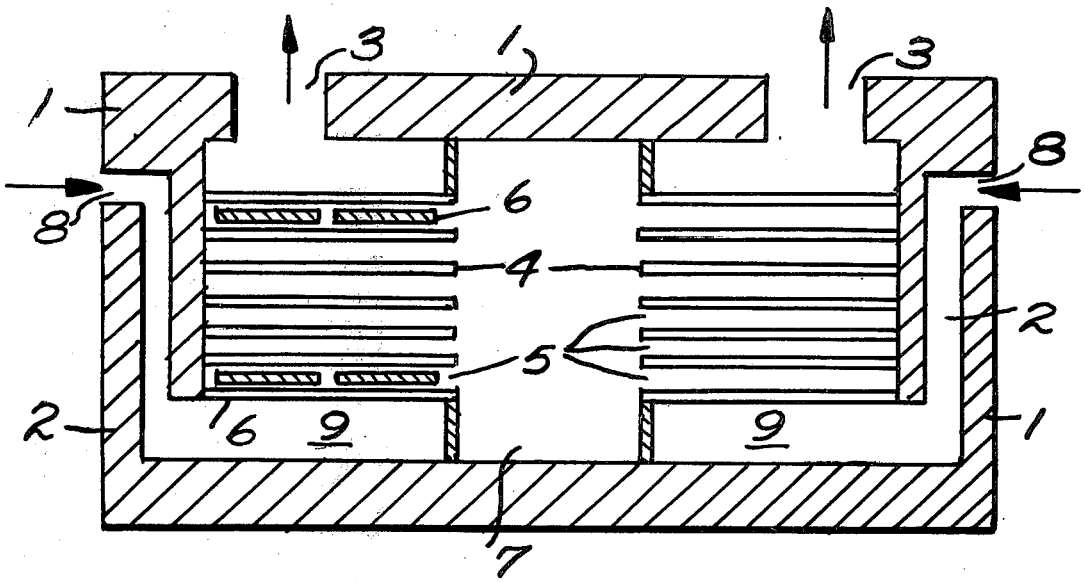
FIG. 1 is a cross section of an apparatus according to the invention.

Referring more specifically to FIG. 1 the concrete chamber (or housing) is provided with shafts 2 for incoming air and shafts 3 for outgoing air which enables the flow of the cooling medium directly to the storage racks 4 in the interior of the concrete chamber 1. The storage racks 4 have horizontal receiving positions 5 which also can be slightly inclined and which contain the containers 6 with the radioactive material. The receiving positions 5 of the storage racks 4 formed in this case as shafts are tightly fitted on one side to the wall of the concrete chamber 1 or the incoming air shaft 2 and on the other side open out to the loading chamber 7. The loading chamber, moreover, can be completely separated from the storage racks 4 and the cooling zone, particularly with indirect cooling. The cooling air is drawing in through the incoming air opening 8 and the incoming air shaft 2 into a distribution chamber 9 below the storage racks 4 from where it moves over the receiving positions 5, is heated thereby by convection and on account of the natural flow leaves the concrete chamber 1 via the outgoing air shafts 3. The stored material preferably enclosed in containers 6 is moved from the loading chamber 7 via corresponding loading devices in the upright positions 5.

The storage racks 4 or the receiving positions 5 are generally made of good heat conducting material, preferably steel. The receiving positions 5 can have any desired cross section but advantageously are circular, are fitted to the containers 6 for the stored material and thus improve the heat transfer from the stored material to the cooling medium.

In order to fix the stored material in the horizontal direction a cover can be installed on the side of the receiving shafts 5 turned to the loading chamber 7 which also prevents the warmed cooling air flowing out of the shafts into the loading chamber and causing undesired increases in temperature there.

As radioactive stored materials there can be employed for example conditioned wastes, gases in pressure cylinders, high temperature reactor fuel elements in canisters or light water reactor fuel elements in boxes. The storage of fuel elements also can take place with indirect cooling without special enclosure in a suitable container.

Figure 3:
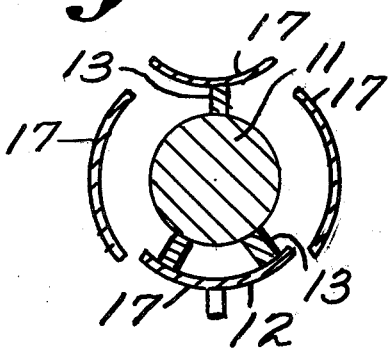
FIG. 3 is a cross section of the storage rack of FIG. 2.
Figure 2:
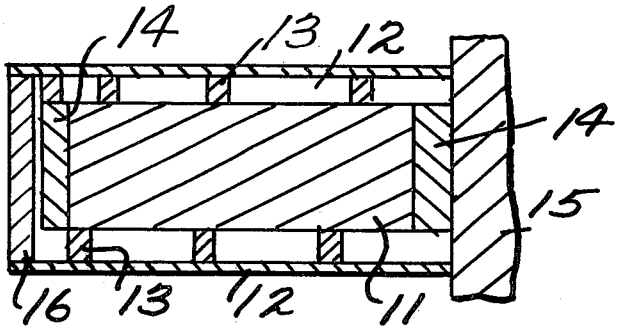
FIG. 2 is a view of a storage rack with an individual receiving position with direct cooling in longitudinal section.

FIGS. 2 and 3 show a storage rack with an individual receiving position in longitudinal section and cross section and with direct cooling. The stored material enclosed in a container 11 is located in a storage rack consisting of segments 12 which are joined together and are provided with support elements 13 on which the container 11 rests and is fixed. The container 11 is held in the axial direction by way of shock absorber 14 through the wall 15 of the concrete chamber and a stop 16 which is loosely joined with the storage support segments 12 and the support elements 13 through screws or snap closures. The storages rack segments 12 and the support elements in this case are so constructed that they only slightly hinder the cooling air flowing upwardly. There is set up on the surface of the stored material a temperature which inside the storage position increases from the bottom upwardly. At higher surface temperatures there is radiated an appreciable part of the heat to the surroundings. Therefore it is advantageous to place radiation shields positioned favorably to the flow around the stored material. The support elements 13 can also be constructed as flanges and thus improve the heat transfer.

Figure 5:
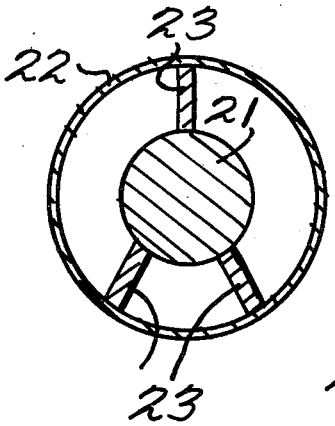
FIG. 5 is a cross section of the storage rack of FIG. 4.
Figure 4:
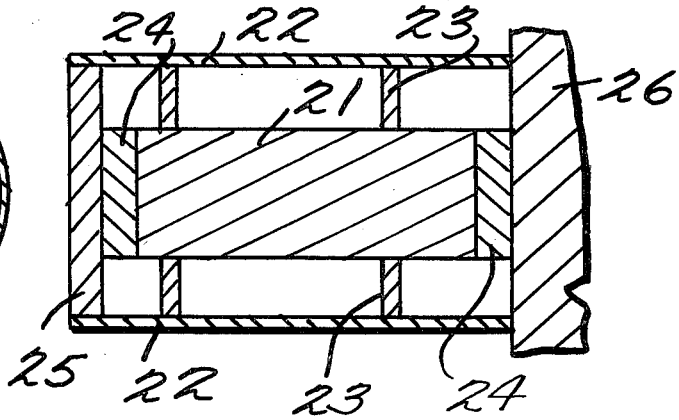
FIG. 4 is a view of a storage rack with an individual receiving shaft with indirect cooling in longitidunal section.

FIGS. 4 and 5 show a storage rack with an individual receiving shaft in longitudinal section and cross section and with indirect cooling. The stored material enclosed in a container 21 is located in a tube 22 which is e.g. cylindrical in cross section. These tubes 22 are joined to a storage position by way of attaching elements (not shown). The container 21 is fixed radially in the tube 22 through supports 23. In axially direction the fixing is performed through the shock absorbers 24, which are arranged at the lid 25 and the end of the shaft or chamber wall 26. The decay heat generated in the stored material is first given off to the environment through radiation and internal convection on the wall of the tube 22 and from there is given off to the surroundings by way of the cooling air. The available heat exchanger surface (tube) for the heat transfer to the secondary cooling system is greater than the heat surface (container) giving off heat through which the temperature of the storage material can be held relatively low without further expense for construction. It is advantageous that with the indirect cooling the stored material through the tube wall is completely separated from the outer cooling system, which guarantees the safe inclusion of the radioactive material even with leakages of the container. To improve the dissipation of heat the tubes 22 can be supplied with cooling flanges, radiation screens and/or baffles.

The entire disclosure of German OS No. 2906629.3 is hereby incorporated by reference.

What is claimed is:

1. An apparatus for storing self-heating radioactive materials, especially irradiated fuel elements which may be enclosed in containers, comprising:

a concrete shell;

an incoming air shaft in said shell for bringing cooling air from the atmosphere therein;

a distribution chamber positioned at a lower portion of said shell and coupled to said incoming air shaft so as to receive cooling air therethrough;

a plurality of horizontally disposed storage racks for receiving said radioactive materials positioned at various heights vertically within the shell from a low point that is above the top of said distribution chamber to a high point that is below the upper end of said concrete shell, said racks configured so as to allow air to flow upwards from said distribution chamber and about said racks, air flowing upwards and about said racks being heated by said radiactive materials;

a central loading area providing access to all of said racks so that radioactive materials can be added or removed from any rack;

an outgoing air shaft in said concrete shell for collecting air heated by said radioactive materials and expelling it to the atmosphere, whereby heat generated by said radioactive material is carried away and into the atmosphere by a natural convection air flow.

2. An apparatus according to claim 1 wherein the plurality of storage racks are superimposed or besides each other.

3. An apparatus according to claim 2 wherein the racks comprise tubes provided with spacing supports.

4. An apparatus according to claim 3 further comprising cooling flanges, irradiations shields or baffles installed on the storage racks.

5. An apparatus according to claim 4 containing several containers stored on one or more storage racks.

6. An apparatus according to claim 2 containing several containers stored on one or more storage racks.

7. An apparatus according to claim 3 containing several containers stored on one or more storage racks.

8. An apparatus according to claim 1 containing several containers stored on one or more storage racks.

9. An apparatus according to claim 2 further comprising cooling flanges, irradiations shields or baffles installed on the storage racks.

10. An apparatus according to claim 1 further comprising cooling flanges; irradiation shields or baffles installed on the storage racks.

11. An apparatus according to claim 1 wherein the racks comprise tubes provided with spacing supports.

* * * * *